US005613526A

United States Patent [19]

Palau et al.

[11] Patent Number: 5,613,526

[45] Date of Patent: Mar. 25, 1997

[54] ELECTRONIC CONTROL OF MOTORS FOR RECIPROCATING THE KNIVES IN A WEAVING LOOM

[75] Inventors: Joseph Palau, Duingt; Jean-Paul Froment, Doussard, both of France

[73] Assignee: Staubli Faverges, Faverges, France

[21] Appl. No.: 530,619

[22] Filed: Sep. 20, 1995

[30] Foreign Application Priority Data

Sep. 27, 1994 [FR] France ..... 94 11772

[51] Int. Cl.[6] ..... D03C 3/20

[52] U.S. Cl. ..... 139/59; 139/65

[58] Field of Search ..... 139/59, 65, 455

[56] References Cited

U.S. PATENT DOCUMENTS 4,433,704 2/1984 Decuq ..... 139/59

FOREIGN PATENT DOCUMENTS 2677380 6/1991 France .
2703697 7/1993 France .
004119260 12/1991 Germany ..... 139/59

*Primary Examiner*—Andy Falik
*Attorney, Agent, or Firm*—Dowell & Dowell

[57] ABSTRACT

In a jacquard system of a weaving machine in which hooks are actuated by harness cords controlled by knives carried by belts supported on drums drivingly connected to drum disc shafts, independent motors having output shafts are provided for driving the drum disc shafts. The motors are controlled to reciprocate the movement of the belts by first sensors monitoring the rotational movement of the motor output shafts and second sensors monitoring the rotational movement of a primary drive shaft of the weaving machine.

5 Claims, 3 Drawing Sheets

ELECTRONIC CONTROL OF MOTORS FOR RECIPROCATING THE KNIVES IN A WEAVING LOOM

BACKGROUND OF THE INVENTION

1. Field of the Invention

The present invention relates to Jacquard systems for the formation of the shed on weaving machines, and more particularly to those in which the reciprocatingly to those in which the reciprocatingly moveable hooks which actuate the cords of a conventional harness are controlled by knives carried by parallel sides of a series of funicular members or belts disposed in pairs.

2. History of the Related Art

French Patent No. 2 677 380 to STAUBLI clearly illustrates the general arrangement of the systems of this type.

For driving this type of system, the movement is taken from the principal shaft of the weaving machine with the aid of a first bevel gear linked by a vertical shaft to a second bevel gear provided at the system to be driven. A horizontal output shaft of this second bevel gear constitutes an input shaft of the system, on which are generally mounted a modulator device adapted to impart to the shaft the movement desired for the system, a device for seeking the shed (unweaving) and a brake for automatically immobilizing the system as soon as the drive input has stopped.

The input shaft of the system must obviously be connected to the drums which ensure reciprocating drive of each of the knife-bearing belts, and on this point reference may be made to what was described and shown in French Patent No. 2 703 697 to STAUBLI. In this arrangement, the input shaft carries two eccentrics for controlling two vertical connecting rods which actuate two horizontal connecting rods connected to the pairs of drums. The drums have different diameters which decrease from one end of the system to the other in order to impart to the knives and to the hooks different strokes adapted to obtain an oblique shed.

It may be ascertained that such a drive mode involves a large number of different parts which increase the cost of the machine. The accessory devices (modulator, brake, shed search) increase the cost, and the connections for adjustments (stroke and obliqueness) are delicate, involving qualified manpower. Moreover, it will be noted that it is impossible to obtain non-plane yarn laps, such as those forming a so-called elliptic shed.

It is an object of the present invention to overcome these drawbacks.

SUMMARY OF THE INVENTION

To that end, the invention essentially consists in driving each of the shafts which carry the drums associated with the pulleys of the same pair of belts, with the aid of an independent electric motor which is supplied through an electronic variator for cyclically reversing the direction of rotation of the shaft and which is controlled by a first rotational sensor associated with the motor drive shaft and a second sensor monitoring the drive shaft of the weaving machine.

Each of the first sensors of the system is connected to an electronic comparator which receives signals from the second rotational sensor linked to the shaft of the weaving machine which send to the variators instructions ensuring suitable rotational movement of the belts with respect to the weaving machine.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
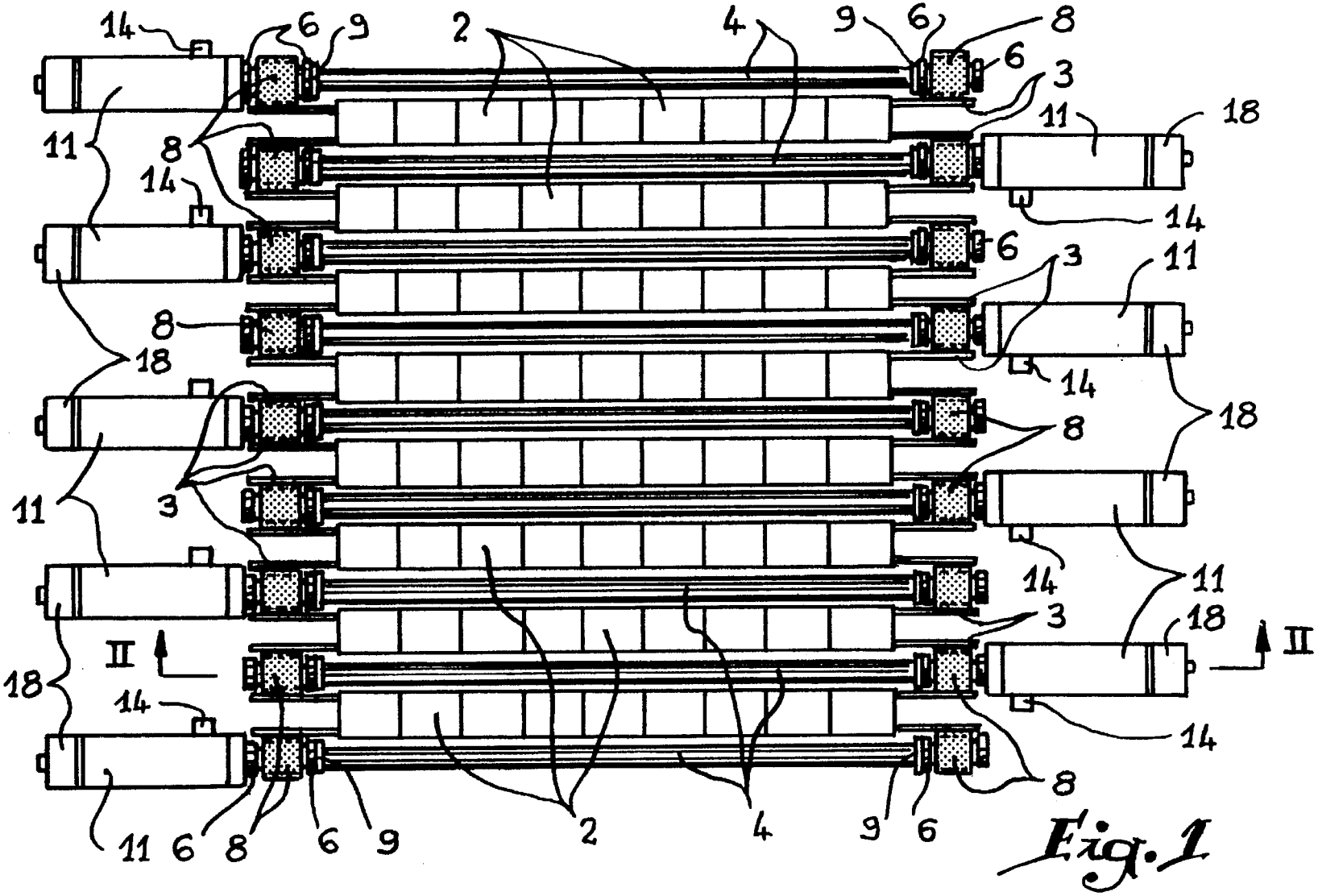
FIG. 1 is a plan view from above of a Jacquard system according to the invention.
Figure 2:
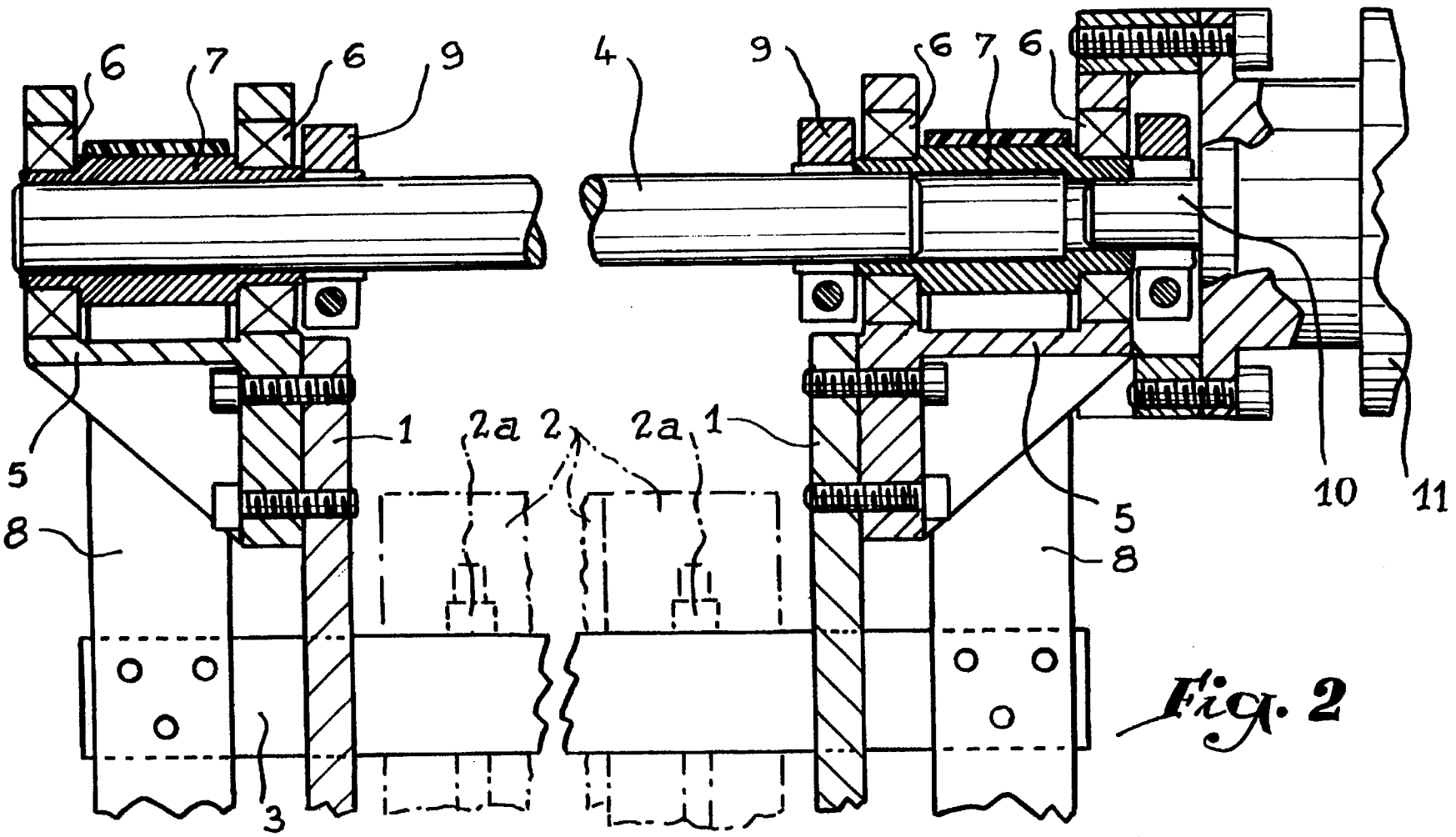
FIG. 2 is a partial transverse section on a larger scale along plan II—II of FIG. 1.

Referring now to the drawings, the frame of the Jacquard system as shown in FIGS. 1 and 2 is formed by two vertical plates referenced 1 in FIG. 2. It is between these two plates 1 that are mounted different vertical rows of modules 2 containing members (control column, electro-magnet, block and tackle, etc.) associated with reciprocatingly movable hooks (shown schematically at 2*a* in FIG. 2) controlled by horizontal knives 3 for actuating the harness cords of the system of the present invention. Between the adjacent rows of modules 2 are mounted horizontal shafts 4 oriented perpendicularly to the plates 1.

As shown in FIG. 2, adjacent each shaft 4, the top of each of the plates 1 is provided with a bracket 5 forming a support for two roller bearings 6 in which are mounted the ends of a horizontal drum 7 for driving vertical belts 8. Each of the pair of belts 8 associated with the same shaft 4 supports two knives 3 disposed at appropriate heights to act on the two hooks of an assembly of modules 2 of the same row.

In the tubular hub of one of the drums 7 (the left-hand one in FIG. 2), is directly engaged the corresponding end of the shaft 4. Rotary drive connection between the shaft and the drum is ensured by a clamping flange 9. The opposite end of the shaft is engaged and clamped in the corresponding end of the other drum 7, the opposite end of the latter receiving a shaft 10 of an electric motor 11 fixed against the bracket 5. A drive connection between shaft 10 and the corresponding drum 7 is, here, likewise effected by means of a clamping flange 9.

In the embodiment shown, it has been assumed that, for obvious reasons of limitation of bulk, the motors 11 for driving the different shafts 4 are disposed in alternate manner on each side of the frame.

Figure 3:
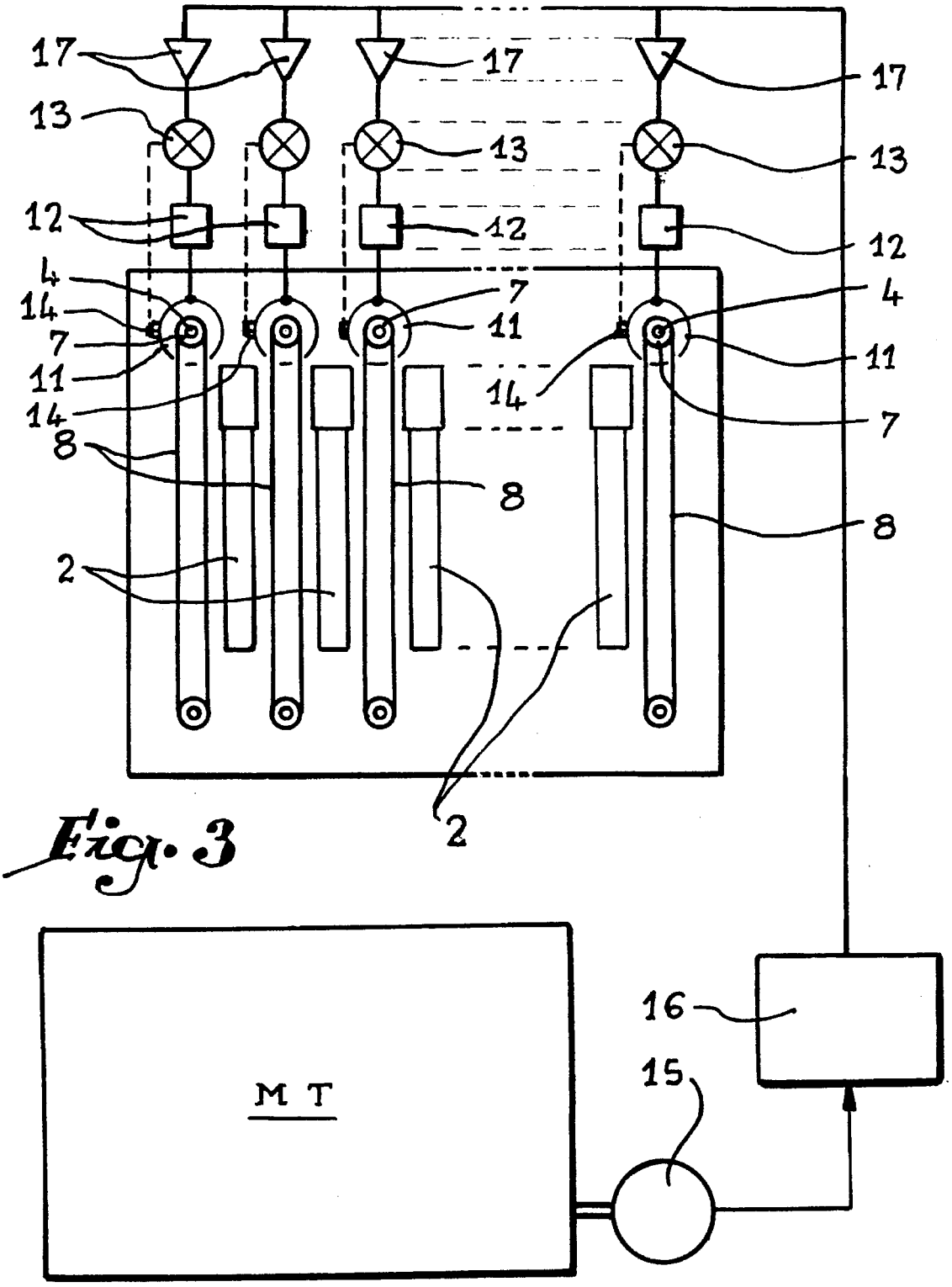
FIG. 3 is a diagram illustrating the electronic supply to the motors.

Motors 11 are of the synchronous, automatically controlled, brushless type and each includes an automatic brake 18 and a first rotational sensor 14. FIG. 3 clearly shows the electric and electronic supply diagram of these motors.

On the electric supply leads of each motor 11 there is provided an electronic variator 12 which ensures cyclic reversal of the direction of rotation of the output shaft 10. This variator 12 is placed under the control of an autonomous electronic comparator 13 which receives signals coming from the first rotational sensor 14 integrated in the motor 11 shown, in order to compare such signals with those coming from a second rotational sensor 15 associated with the drive shaft of the weaving machine MT to thereby detect the rotational position of the shaft.

At the output of the sensor 15 and before being sent to each of the autonomous comparators 13 by way of electronic connecting means or lead 16', the signals are processed by a common electronic converter 16 to convert the continuous-rotation signals into alternative-rotation signals, and by independent or separate amplifiers 17 adapted to control the motors 11 to determine the length of the alternative stroke of displacement of the two belts 8 as a function of the position of the shafts 4 of the system (obtaining of an oblique shed).

The independent drive of each shaft 4 makes it possible to overcome the drawbacks mentioned hereinabove. In addition, it will be noted that the obliqueness of the shed is modified by varying the amplifiers 17, while, in the conventional Jacquard systems with central drive derived from the motor of the weaving machine, this same modification constitutes a very complex operation, involving the change of a series of mechanical components and delicate adjustments.

The need for accessory devices such as modulators, shed search, automatic brake, etc. of the conventional systems is thus eliminated. It is easy to obtain any type of shed desired, even an elliptic shed, by use of the amplifiers 17.

What is claimed is:

1. In a weaving machine having a drive shaft and reciprocating hooks which actuate harness cords and which are controlled by knives carried by parallel sides of a plurality of pairs of belts moveable in a reciprocating motion, the improvement comprising:

each pair of belts being drivingly connected to a shaft driven by an electric motor, electronic variators connected to each of said electric motors for supplying electrical signals cyclically reversing a direction of rotation of an output of each electric motor, and first sensor means for sensing a rotational position of the output of each of said electric motors and for supplying signals to electrical input means connected to each of said electronic variators to thereby control the cyclic reversal of the direction of rotation of said outputs of said electric motors.

2. The improvement for a weaving machine of claim 1 wherein said electrical input means to said electronic variators includes a plurality of electronic comparators for receiving signals from said first sensor means, a second sensor means for sensing the rotational position of the drive shaft of the weaving machine, and means for connecting the signal from said second sensor means to said electronic comparators whereby said electronic comparators compare both the signals from said first sensor means and said second sensor means for controlling the electrical signals from said electronic variators to said electric motor.

3. The improvement for a weaving machine of claim 2 wherein said signals from said second sensor means are processed by an electronic converter, a plurality of amplifiers, each of said amplifiers being connected to a separate one of said comparators, and means for electronically connecting said electronic converter to said amplifiers.

4. The improvement for a weaving machine of claim 3 wherein each of said electric motors includes an automatic brake.

5. The improvement for a weaving machine of claim 1 wherein each of said electric motors includes an automatic brake.

* * * * *